US007093518B2

(12) United States Patent
Gmeilbauer

(10) Patent No.: US 7,093,518 B2
(45) Date of Patent: Aug. 22, 2006

(54) TOOL FOR TENSIONING, SLACKENING AND OPENING SPRING-CLIP ELEMENTS

(76) Inventor: Engelbert Gmeilbauer, Stocketweg 1, Seefeld (DE) D-82229

( * ) Notice: Subject to any disclaimer, the term of this patent is extended or adjusted under 35 U.S.C. 154(b) by 0 days.

(21) Appl. No.: 10/297,219

(22) PCT Filed: May 23, 2001

(86) PCT No.: PCT/DE01/01959

§ 371 (c)(1),
(2), (4) Date: Dec. 2, 2002

(87) PCT Pub. No.: WO01/91976

PCT Pub. Date: Dec. 6, 2001

(65) Prior Publication Data

US 2004/0011161 A1 Jan. 22, 2004

(30) Foreign Application Priority Data

May 31, 2000 (DE) ..... 100 26 847

(51) Int. Cl.
*B25B 27/10* (2006.01)

(52) U.S. Cl. ..... 81/9.3; 81/314; 81/485; 81/487; 29/229; 29/237; 29/243.56

(58) Field of Classification Search ..... 81/9.3, 81/485–487, 301–302, 129, 131, 355, 126, 81/342, 314, 421, 424, 418; 29/237, 243.56, 29/225, 229, 239, 268; 269/6, 20, 21, 25, 269/26, 86, 43, 165, 216, 228
See application file for complete search history.

(56) References Cited

U.S. PATENT DOCUMENTS 5,009,134 A * 4/1991 Sorensen et al. ..... 81/487
5,022,291 A * 6/1991 McBain ..... 81/424
5,154,398 A * 10/1992 Mayfield ..... 269/6
5,590,573 A * 1/1997 Detable ..... 81/9.3
6,189,190 B1 2/2001 Gillet et al.
6,634,258 B1 * 10/2003 Pool et al. ..... 81/9.3

FOREIGN PATENT DOCUMENTS

DE 4312846 4/1994
DE 4418763 11/1995

(Continued)

*Primary Examiner*—Hadi Shakeri
(74) *Attorney, Agent, or Firm*—Klaus P. Stoffel; Wolff & Samson PC

(57) ABSTRACT

A tool for tensioning loosening, and opening spring-type clamping elements with two radially outward-projecting actuating arms, the tool including a hand-operable actuating part, a Bowden cable having a bore and a sheath, the Bowden cable being connected to the actuating part, and a tensioning part with two jaws which are able to move relative to each other. Each of the jaws is configured to act on one of the actuating arms, a first one of the jaws being connected to the core, and a second one of the jaws being connected to the sheath of the Bowden cable so that the jaws can be brought toward each other and thus execute a tensioning movement. The actuating part includes a device for automatically locking in a tensioning stroke and a device for feeding the Bowden cable. The feed device and the locking device of the actuating part are configured to cooperate so that several short tensioning strokes of any desired length can be performed without predefined latching steps, the stroke being locked in place each time until a required total tensioning stroke has been completed.

10 Claims, 4 Drawing Sheets

FOREIGN PATENT DOCUMENTS

| | | |
|---|---|---|
| DE | 29515050 | 1/1996 |
| DE | 29603425 | 6/1996 |
| FR | 2740765 | 5/1997 |
| WO | WO9826904 | 6/1998 |

* cited by examiner

TOOL FOR TENSIONING, SLACKENING AND OPENING SPRING-CLIP ELEMENTS

The invention pertains to a tool for tightening, loosening, and/or opening spring clip elements, especially hose band clamps with two arms projecting radially outward at an angle of less than 80° from each other, such as those used in the field of automotive manufacturing, according to the introductory clause of claim 1.

The hose band clamps normally used in automobiles today are tightened with screws, but it is known that they are being replaced by self-tightening spring-type hose band clamps. These are used, for example, to connect the cooling water hose to the radiator and to the engine. To loosen these spring clamps, it has usually been necessary in the past to use relatively large and therefore cumbersome pliers.

Thus, for example, DE 33 43 501 C1 describes a tool for expanding a spring ring clamp, the actuating part of which is designed like a cartridge gun for caulking compounds and adhesives. The pushrod has teeth forming a row down the length of the rod, which work together with forward-feed and locking catches. At the outer end of the relatively long, thick shaft of the actuating part, there are two sidepieces with contact surfaces, onto which the spring arms, which are at an angle of more than 180° to each other, can be hooked. The pushrod is also designed as a pressure piston, which pushes against the center of a ring firmly held on the arms, with the result that the ring is opened. The tool can therefore be used only in freely accessible locations, namely, for spring clamps with arms which are essentially diagonally opposite each other. It cannot be used for clamps with arms which are at an angle of less than 180° from each other. In addition, because the forward feed depends on the teeth on the pushrod, fixed minimum distances are predefined for the individual steps by which tightening can be accomplished. It is therefore impossible to perform a tightening operation with strokes of continuously variable size or with extremely small strokes.

Hose clamp pliers are known from WO 98/26,904, from DE 296 03 425 U1, and from the catalog "Profitec" from Paschke, page 27, "New Products for '96". These pliers are used to tighten, to lock, and to expand hose clamps, and each one consists of a pliers-like actuating part with tensioning arms at the forward end. The ends, that is, the end of the core and the end of the sheath, of a Bowden cable are attached to these tensioning arms in such a way that, when the handles of the pliers are squeezed together, the tensioning arms open, and thus the core of the Bowden cable is pulled out of the cable to a corresponding extent. A tightening part is attached to the other end of the Bowden cable; this part consists of two tensioning jaws, which are able to move relative to each other. They are designed to grip the arms of the hose clamp, and they are pressed together when tension is applied to the core of the Bowden cable by way of the actuating element,. As a result, the clamping diameter of the clamp is increased, and the clamp releases the hose. These known hose clamp pliers also have a locking device, which automatically locks the pliers when the stroke required for the tensioning operation is completed. There is therefore no longer any need to keep squeezing the pliers by hand while the released clamp and the tensioning part clamped firmly to it are removed and possibly while the hose itself is removed as well. With this known type of hose clamp pliers, the entire tensioning or loosening stroke must be performed with a single compression of the arms of the actuating part. Here again, the stroke has only a single, predefined length. It is impossible to vary the length of the stroke, and therefore the clamps cannot be tightened or loosened to different degrees. In addition, the jaws of the tensioning part, which are essentially parallel to each other, contact only the sides or side edges of the clamp arms which are facing away from each other. When the arms are squeezed together to such an extent that the arms become almost parallel to each other in the loosened state of the clamp, the tensioning jaws can easily slip off the clamp. The reliability with which spring clamps can be handled in their tensioned or opened state is therefore insufficient. Finally, because the mechanism which pushes the tensioning jaws is relatively long and rigid, the pliers cannot be used or at least cannot used optimally in areas to which access is relatively difficult.

The task of the invention is to provide a tool of the general type indicated above which is simple and reliable in design and operation, which can be used for many purposes in optimal fashion, even in relatively inaccessible locations, and which also allows short, continuously variable tightening strokes without locking points at predefined distances.

This task is accomplished by a tool with the characterizing features of claim 1. Advantageous embodiments are characterized in the subclaims.

Accordingly, the actuating part and the locking device provided thereon are designed and cooperate with each other in such a way that several short tensioning strokes of any desired length can be made in a continuously variable manner, and so that the position reached after each partial stroke is locked in place until the entire tensioning stroke either necessary or desired has been completed. This offers in particular the advantage that there is no longer any limitation to a specific, predefined total tensioning stroke accomplished by a single compression of the gripping arms of the actuating part, especially since the total tensioning distance which must be covered may well be greater than the compression of the grips which can be accomplished with one hand. It is now possible, according to the invention, to arrive at the complete tensioning stroke of the tensioning jaws by making several successive, relatively short tensioning strokes of any desired length, not limited by teeth or the like to discerete steps, these strokes being accomplished by squeezing the actuating part multiple times with a pumping type of action. This can be done without excessive force and with a single hand, so that the other hand is free to check simultaneously whether the clamp has been loosened sufficiently to be removed from the hose or removed together with the hose from, for example, the engine.

It is advantageous for the actuating part of the tool according to the invention to be designed essentially in the manner of the actuating part of a cartridge gun known in and of itself for caulking compound and adhesive cartridges with a smooth pushrod, which can be pushed forward intermittently in short strokes by way of a thrust washer and a locking lever. The actuating part of a cartridge gun currently available on the market can in principle be used. So that the pushrod can be fed forward continuously, however, i.e., without steps of predefined length, a smooth pushrod (without latching teeth or levers) with an intermittently cooperating thrust washer and locking lever is provided. In principle, it is necessary merely to remove the projecting gun barrel-like half-shell used to hold the cartridge from the housing, to shorten the pushrod because of the shortness of the stroke now required, and to attach a Bowden cable so that the mechanism can be actuated. According to the invention, the Bowden cable is attached in such a way to the forward end of the housing of the actuating part that the sheath of the cable is held in place at the forward, outer end of the pushrod, whereas the core of the Bowden cable is attached to the end surface of the housing near the exit point of the pushrod. When the pushrod is pushed forward, a pressure is exerted on the sheath, as a result of which the core projecting from the sheath at the other end of the cable is pulled inward into the sheath and thus shortened, and the clamping jaws are thus tensioned or squeezed together.

It is advantageous for a clamping body to be attached to the forward end of the pushrod, which body has a radially offset clamping bore for the Bowden cable extending parallel to its pushrod attachment bore. If, in addition, the clamping body is attached to the pushrod and the Bowden cable core is attached to the outer end surface of the body so that they can be easily detached, and if simultaneously the Bowden cable can be held in place in the clamping body by means of, for example, radial setscrews, that is, if the core of the Bowden cable can be held immovably in place in the Bowden cable or together with it in the clamping body, then the actuating part can be separated quickly and easily from the Bowden cable and put to use elsewhere in cooperation with other, similarly equipped Bowden cables. It is easy to see that, by clamping the Bowden cable to hold it in place, the springs can be held in the tensioned, i.e., opened or loosened, state, and thus it is possible simply to set aside the disconnected Bowden cable along with the tensioned spring clamp attached to it. The actuating part, which is now free, can be used to tension or loosen other clamps. A single actuating part can therefore be used with several Bowden cables and tensioning jaws to form a tool set with many and varied applications.

The end of the core facing the housing is especially easy to disconnect from the housing if a fastening body is mounted detachably on the forward, outer end surface of the housing, through which body the pushrod passes and onto which the end of the core can be easily hooked or to which the end can be attached in some other way so that it can be easily clamped in position. Of course, the fastening body can also be mounted permanently on the end surface of the housing or constitute an integral part of the housing.

The clamping body which can be attached to the pushrod can advantageously be designed as a multiple clamping body; that is, several clamping openings for several, e.g., three, Bowden cables can be assigned to the clamping opening used to clamp the body to the pushrod and arranged symmetrically around it. Of course, in this case, a corresponding number of hooking or fixation measures for the cores of the several Bowden cables will also be provided in the fastening body. As a result, a single actuating part can be used to open or close all the clamps of an assembly in a motor vehicle simultaneously in single work step. It would be possible, for example to release all three radiator hose connection clamps simultaneously, that is, the clamp on the feed connection, the clamp on the outlet connection, and the clamp on the vent opening. After these connections have been released, all three Bowden cables can be clamped firmly on the clamping body; this body can be disconnected from the pushrod and the cores disconnected from the fastening body; and the clamping body and the cores can be easily set aside together and without the heavy, cumbersome actuating part until the repairs in question have been completed and the hoses are to be reconnected and the clamps reattached, which is accomplished by rehooking or reattaching the cores to the actuating part and releasing the actuating part. This releasing is done essentially in the same way as with the cartridge guns, that is, by pressing on the locking lever to release the pushrod. In the case of the cartridge gun, however, the pushrod must be pulled back by hand after it has been released, whereas in the case of the tool according to the invention, the pushrod is pushed back automatically, so to speak, by the effect of the spring force of the hose clamps.

It is also especially advantageous according to the invention that the two tensioning jaws are designed as essentially loose, independent blocks, which are guided loosely on the Bowden cable. The outer end of the sheath of the Bowden cable can be held in a continuous clamping bore passing through the first jaw block, whereas the outer end of the core projecting from other end of the block can be held in the second jaw block. The two jaws have transverse insertion slots with transverse stops, which allows them to be set down radially like shoes onto the arms of the spring clamp. After the Bowden cable has been relaxed, therefore, it is easy to push the jaws radially onto the arms regardless of the position of the clamp or of the clamp arms. Then the clamp can be tensioned. These jaws do not slide off the clamp arms even after the clamp arms have become nearly parallel to each other during the course of the tensioning process. The transverse insertion slots are perpendicular to the direction of the tensile force, that is, to the orientation of the Bowden cable, but if the ends of the spring clamp arms are parallel to the circumference of the clamp, the slots can also be parallel to the cable.

It is especially easy to install the two loose jaw blocks if the Bowden cable end is not attached tightly to the second jaw but is rather hung easily and simply on it, e.g., by way of a slot in the top surface of the jaw, pointing in the direction of the tensile force. To prevent the core from slipping off, the end can be equipped with a hanging part, which can be hook or a cylindrical or conical area of greater thickness. Of course, a corresponding recess, e.g., a bore coaxial to the hanging slot, can also be provided in the contact surface for the hanging part. The hanging block is inserted into this bore and thus obtains axial support. But it is also possible for the core of the Bowden cable to pass through the first jaw and hook onto it. For this purpose, it is effective to provide the forward end of the sheath of the Bowden cable with a pressure piece, which rests against the end surface of the first block during the actuation of the Bowden cable. The two jaw blocks can therefore be designed identically with respect to their top surfaces; that is, each one can have an insertion slot for the core of the Bowden cable and possibly a recess in the outer end surface for the contact end of the core or the pressure end of the Bowden cable sheath.

Instead of the shoe-shaped jaws which can be pushed radially onto the arms of the clamp, it is also possible to provide frame yokes, which are hooked over the clamp arms. One frame yoke can be provided for each arm. It is also possible, however, to provide merely a transverse tensioning bar instead of the first tensioning jaw and to provide a frame yoke instead of the second tensioning jaw. These components, furthermore, can be attached either directly to the sheath and to the core or indirectly via angle arms, in which case the yokes act on the bases of the arms, which has the effect of elevating the point at which the tensile force is exerted in the radial direction and thus of increasing the tensioning torque.

The two tensioning jaws, however, can also be connected to each other in a sliding manner by way of a slide arm and thus even connected in a manner similar to that of the tensioning part of the known hose clamp pliers previously described. The difference, however, is that, according to the invention, this slide arm is preferably made out of a strip of spring steel, which flexes elastically in the circumferential direction of the clamp. Thus, the angle of the jaws or of their transverse insertion openings can shift with respect to each other. The jaws thus adapt to the angular orientation of the relaxed and tightly seated hose clamp arms and can be pushed radially onto these arms as intended. The spring arm, which deflects outward on the second jaw in the tensioning direction and passes through the first jaw in this same direction while exerting thrust on it, projects out at least a short distance from the first jaw even when the jaws are open to the maximum extent. This projecting end has a hanging opening. The core of the Bowden cable can have a hook for example, which can be hung in this opening, while the sheath of the Bowden cable is tightly held in a pressure piece, which extends axially over the end of the core projecting out from the sheath and also over the end of the spring arm projecting out from the first block. The end surface of this pressure piece simultaneously supports itself against the outer end surface of the first jaw. Upon the actuation of the tool, the core is held firmly in place, whereas the sheath is pushed forward along with the pressure piece, as a result of which the first jaw is pushed toward the second jaw. As a result, the arms of the spring clamp located in the jaw insertion slots are pushed toward each other, and thus the spring clamp is opened or loosened. A setscrew in the first jaw, furthermore, can be used to clamp tightly the spring arm passing through the jaw, as a result of which the squeezed-together arms of the clamp are held firmly in this position. This now makes it possible to unhook the Bowden cable to be unhooked from this tensioning element.

It is also advantageous to provide an essentially U-shaped retaining yoke, which can be set axially down over the squeezed-together or tensioned actuating arms of the hose clamp. As a result, the clamp arms can be securely held in the tensioned state, so that the tensioning jaws can now be pulled away and the entire tool can be put to use somewhere else. When the clamp is to be reinstalled on another hose, for example, a pliers can be used to pull the retaining yoke from the arms, or a screwdriver can be used as a lever to pry it off, after which the clamp springs close, and the arms move tangentially away from each other.

The retaining yoke can be designed as a single piece, or it can consist of two jaw parts, which can move with respect to each other and which can be fixed in a desired jaw opening position with respect to each other by way of known locking devices such as a clamping lever or a setscrew. The two-part design can also serve merely to accelerate the attachment process.

The invention is explained in greater detail below on the basis of several exemplary embodiments with reference to the drawing.

Figure 1:
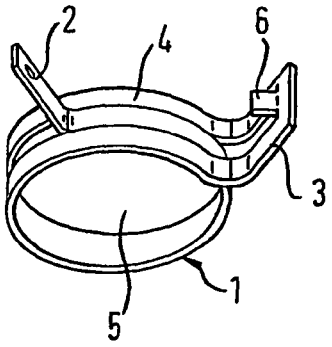
Prior Art Fig. 1
FIG. 1 shows a perspective view of a spring clamp known in and of itself.

As can be seen in FIG. 1, a hose clamp 1, as used especially in the automotive field, has a narrow clamp arm 2 and a wide clamp arm 3, which project essentially in the radial direction from the clamp ring 4, which has an inner clamping diameter 5. The wide clamp arm 3 has a short, outward-bent tab 6, pointing toward the narrow clamp arm 2.

Figure 2:
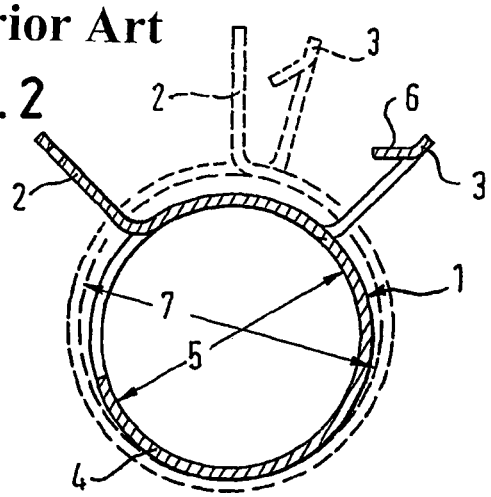
Prior Art Fig. 2
FIG. 2 shows an axial view of the spring clamp according to FIG. 1 in the tensioned (dotted line) and in the relaxed state.

FIG. 2 shows an axial view of the clamp according to FIG. 1 in the relaxed state, but it also represents the state of the clamp in which it could be clamping a hose, for example. The broken lines show the same clamp 1 in the tensioned state, that is, the state in which the clamp arms 2, 3 are squeezed together, as a result of which the clamping diameter 5 has been expanded to the clamping diameter 7. In this state, the clamp loosely surrounds the hose to be fastened. To loosen the hose clamp 1, the corresponding tensioning elements of the tool are applied to the two clamp arms 2, 3 to squeeze them together; when the force is released, these arms spring back away from each other and tightly squeeze the hose around its circumference, clamping onto the component in question.

Figure 3:
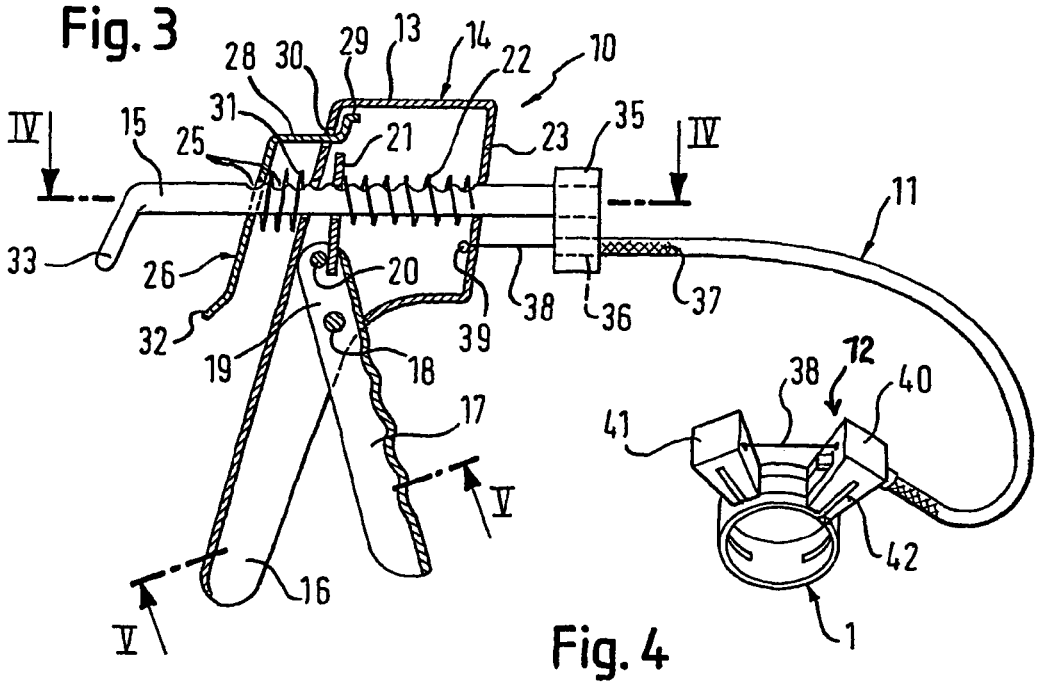
FIG. 3 shows a longitudinal, axial cross section through a first embodiment of a tool.
Figure 4:
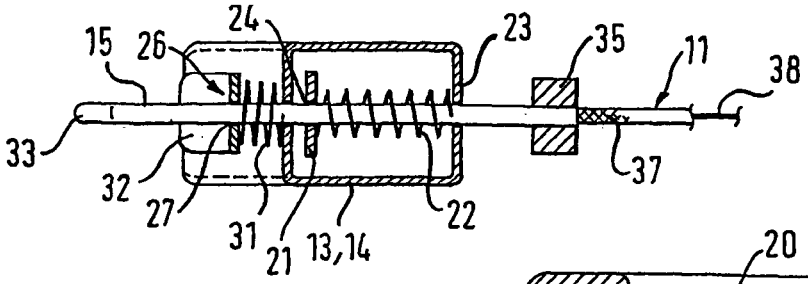
FIG. 4 shows an axial cross section along line IV—IV of FIG. 3.
Figure 5:
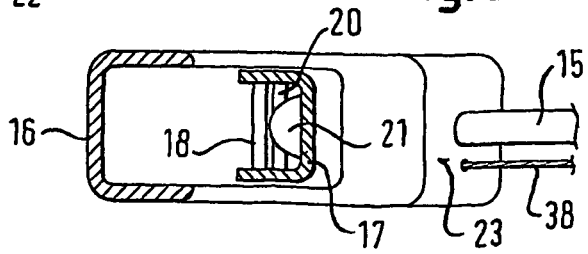
FIG. 5 shows a cross section along line V—V of FIG. 3 through the arms of the actuating part.

The first embodiment of a tool shown in FIGS. 3–5 consists essentially of an actuating part 10, a Bowden cable 11 connected thereto, and a tensioning element 12 at the other end of the cable, which element can be set actively onto the clamp 1.

The actuating part 10 is almost identical to or is at least the same in terms of it function as the actuating part of a cartridge gun for caulking compounds and adhesives known in and of itself, except that here the receptacle shell projecting out from the front of the cartridges has been eliminated and the pushrod has been shortened. The actuating part has a housing 13 and a pushrod 15, which passes with freedom of axial movement through the upper head part 14 of the housing, The actuating part also has an essentially U-shaped, downward-bent housing arm 16. An actuating arm 17 is hinged by way of a pivot axle 18 to the housing 13 at essentially the upper end of the housing arm 16. A thrust arm 19 forms a straight extension of the actuating arm, and a transverse thrust stud 20 is attached to its upper end, i.e., to the end passing under the pushrod 15. The arm 17 of the actuating part also has a U-shaped cross section, as can be seen especially clearly in FIG. 5.

Inside the head part 14 of the housing, a thrust washer 21 is located movably on the pushrod 15; the thrust stud 20 on the actuating arm 17 acts on the lower segment of this washer, which is under the pressure of the compression spring 22. The spring is guided on the pushrod 15 between the end wall 23 and the thrust washer 21. The internal bore 24 in the thrust washer 21 is dimensioned with respect to the diameter of the pushrod 15 passing through it in such a way that, when the tool is actuated, that is, when the actuating arms 16, 17 are squeezed together, the pivoting actuating arm 17 pushes the thrust washer 21 forward eccentrically by way of the thrust arm 19 and the thrust stud 20, as a result of which the internal bore in the washer tilts on edge on the pushrod 15 and carries the rod along with it as it moves forward. To reinforce this carry-along movement and to provide for a secure engagement between the washer and the pushrod, notches 25 can be provided in the top surface of the pushrod 15, extending in a row down the length of the rod, as is also known from the pushrods of the known cartridge guns. When the pressure on the actuating arm 17 is then released, the compression spring 22 presses the thrust washer 21 back again toward the rear and pivots the arm 17 back into the starting position.

On the rear of the head part 14 of the housing, a locking lever 26 is mounted to serve as an arresting device. This lever has a locking bore 27, through which the pushrod 15 passes. The locking lever 26 has a downward-pointing release arm 32 and a double-cranked hook arm 28 extending upward. This hook arm 28 has a hook tab at the end, which passes through a corresponding insertion opening in the rear wall of the head part 14 and thus hooks the arm in place. The hooking connection also gives the locking lever 26 a pivoting support point in the housing. Between the locking lever 26 and the rear wall of the head part 14, a compression spring 31 is provided, which always keeps the locking lever 26 pressed toward the rear, that is, in a position in which locking bore 27 is resting at an angle against the outer circumference of the pushrod 15. When the pushrod 15 is pushed axially forward by way of the actuating arm 17, the thrust stud 20, and the thrust washer 21, the locking lever also pivots forward easily. The bore 27 thus releases the pushrod, which can now slide forward in the bore. The compression spring 31, however, always keeps the locking lever 26 pressed backward against the pusbrod 15 by way of the arresting bore 27. As a result, whenever the locking lever is in its rearward-pressed, slanted position, it is impossible for the pushrod 15 to be pushed backward. When the user opens his hand and thus releases the actuating arm 17, the compression spring 22 presses the thrust washer 21 back again toward the rear, as a result of which the actuating arm 17 is carried along elastically and pivots back into the starting position. During the backward movement of the thrust washer 21, the pushrod 15 remains or is held in position by the locking lever 26, because the thrust washer 21 is pushed toward the rear in a flat state, that is, not at an angle, by the spring 22, which exerts pressure on it concentrically. The pushrod 15 is thus pushed forward by the thrust washer 21 when the actuating arm 17 is squeezed, while the locking lever 26 remains resting against the pushrod in a ready-to-lock position at all times. When the actuating arm 17 is released, the thrust washer slides backward under the force of the spring, whereas the locking lever 26 immediately acts to retain the pushrod in position, preventing it from slipping backward. No matter how small the squeeze on the actuating arm 17 and thus no matter how short the forward feed of the pushrod, the pushrod 15 will always be held reliably in place at end of the feed movement. When the lower release arm the locking lever is pressed toward the housing, the locking lever 27 pivots out of its arresting, slanted position into a vertical position, which releases the pushrod, so that the pushrod can be guided backward into the no-load position. This return movement occurs under the action of the force of the spring clamp 1 while the tensioning part 12 is under tension. When the locking lever release arm 32 is pressed, the pushrod 15 will therefore snap back elastically toward the rear. This spring-actuated rearward movement of the pushrod 15 does not occur when the tensioning part is not under the tension associated with the use of the device, and the pushrod must therefore be moved back by pulling on a gripping part provided at the rear, here a downward-bent pull arm 33.

A clamping body 35 is attached to the forward end of the pushrod 15; in the present exemplary embodiment, this body is mounted eccentrically and has a clamping bore 36, which is parallel to the clamping bore by which it is seated on the pushrod 15. The Bowden cable 11 is guided through this bore along an axis parallel to the pushrod 15 in such a way that the end of the sheath 37 of the Bowden cable is held permanently in the bore, whereas the inward-projecting core 38 of the Bowden cable, which is also parallel to the pushrod 15, extends all the way to the end wall 23 of the head part 14 of the housing, to which the attachment end 39 of the Bowden cable core is permanently fastened.

As can be seen especially clearly in FIG. 3, the tensioning part 12 is attached to the terminal end of the Bowden cable 11; this tensioning part consists of two individual jaws 40, 41, which are shown in here in the state in which they have been pushed onto the clamp arms, each by way of an insertion slot 42. It can be seen that the Bowden cable 11 extends into the first jaw 40, in which the end of the Bowden cable sheath is fastened in place. The Bowden cable core 38 extending out from the inside surface of the jaw 40 is attached by its terminal end to the jaw 41. When the tool is actuated, that is, when the pushrod 15 is pushed forward, the clamping body attached to the pushrod is also pushed forward, and with it the sheath of the Bowden cable fastened therein. Because the core 38 of the Bowden cable is held firmly in place by its attachment end 39 on the housing, the forward movement of the Bowden cable sheath 37 causes the core to be pulled out of the sheath in the direction of the housing, as a result of which, at the tensioning part 12, the part of the core 38 projecting out between the two jaws 40, 41 is pulled to a corresponding extent into the Bowden cable sheath, simultaneously shortening the distance between the two jaws 40, 41. As the two jaws 40, 41 approach each other, the clamp arms 2, 3, on which the jaws are seated are also brought closer together, that is, squeezed together, as a result of which the released position of the spring clamp 1 shown in broken lines in FIG. 2 is produced.

Figure 6:
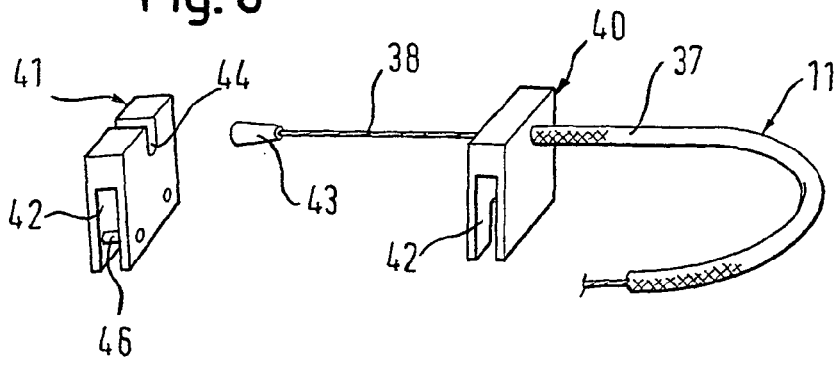
FIG. 6 shows a perspective view of a first embodiment of the tensioning part, with loose jaw blocks and a hookable core.
Figure 7:
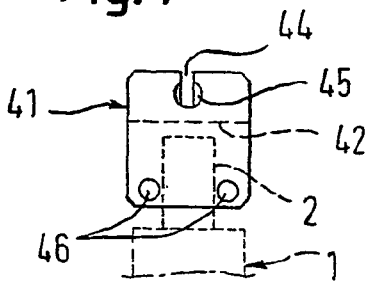
FIG. 7 shows an external, end view of the second jaw block.
Figure 8:
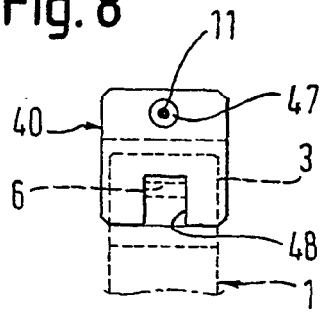
FIG. 8 shows a vertical cross section through the jaw block of FIG. 7.

A first embodiment of a tensioning element 12, which is essentially the same as that according to FIG. 1, is shown in FIGS. 6–8. The two jaws 40, 41 are also designed as individual jaw blocks, the first jaw 40 being connected permanently to the sheath 37 of the Bowden cable 11, which passes through it. The second jaw 41 in this embodiment, however, is not connected permanently to the end of the core 38. In this case, the core 38 can be connected detachably to the jaw 41 by means of a hooking block 43 at the end of the cable, which is inserted into the hooking slot 44 extending in the tension direction in the top surface of the jaw 41. To make sure that the hook connection is secure, a hooking bore 45 is provided in the outward-facing side of the jaw; this bore conforms to the shape of the hooking block 43, so that, when this block is introduced into the bore in the tension direction and hook in place there, the core cannot slide out. Because the core can be detached from the second jaw 41, the jaws, which have now been separated from each other, can be put in place individually and therefore more easily, even in highly awkward locations, on the clamp arms. The only thing necessary now is to push the end of the core over the second jaw 41 to establish the necessary functional connection.

FIG. 7, which represents an outside view of the jaw 41 of FIG. 6, shows the previously described design with the hooking slot 44 and the hooking bore 45, by means of which the hooking block 34 of the core 38 can be connected to the jaw. It can also be seen that, to ensure the secure placement of the jaw 41 onto the narrow clamp arm 2, which is shown here in broken line for the sake of clarity, the transverse slot 42 is provided with guide pins 46 to serve as lateral boundaries. Of course, instead of these guide pins 46, it would also be possible to provide appropriate walls, or, instead of the transverse slot and the guide pins, it would be possible to introduce directly into the jaw 41 an insertion opening open only at the bottom to accept the narrow clamp arm.

In the case of the first jaw 40 shown in FIG. 8, which offers a view of the inside surface, it can be seen that a bore 47 is provided at the top, through which the Bowden cable 11 passes and in which the outer end of the sheath is fastened. At the bottom, a rectangular opening 48, open at the bottom, is provided, which extends all the way to the transverse slot. After the jaw 40 has been pushed onto the wide clamp arm 3, the inner tab 6 of the clamp arm 3 projects through this opening. The opening 48 enclosing the sides of the tab 6 thus limits the displacement of the jaw 40, so that no additional boundaries such as those which might be provided by the walls enclosing the transverse slot 42 are required for this jaw.

Figure 9:
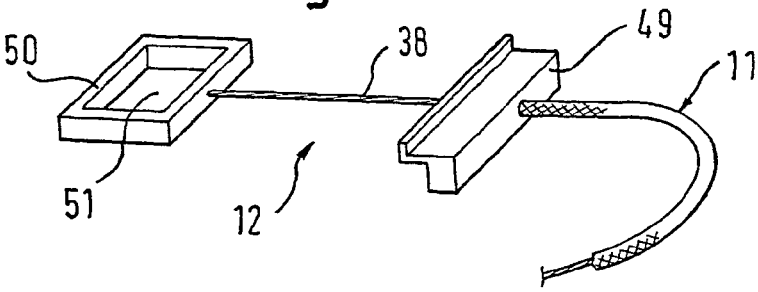
FIG. 9 shows a perspective view of a second embodiment of a tensioning part with a tensioning bar and a tensioning frame yoke.

In the case of the additional embodiment of the tensioning element shown in FIG. 9, a tensioning bar 49 is provided instead of the first jaw; this bar has an essentially L-shaped or approximately Z-shaped cross section. Instead of the second jaw, a frame yoke 50 is provided. The core 38 is permanently connected to one of the side strips of this frame. The rectangular opening 51 in the frame yoke 50 can be placed over/hooked onto the clamp arm.

Figure 10:
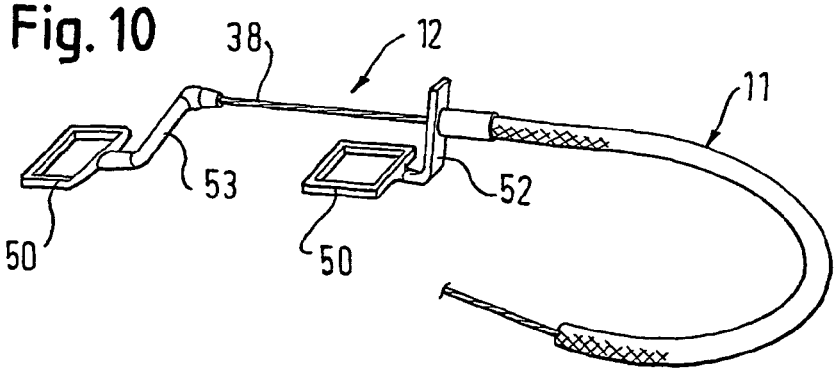
FIG. 10 shows a perspective view of a third embodiment of a tensioning part comprising two frame yokes with a crank-like offset attachment of the arms.

In the case of the additional embodiment of the tensioning part 12 shown in FIG. 10, a frame yoke 50 is provided for each of the two clamp arms. Here, however, the yokes are not connected directly to the core or to the sheath of the Bowden cable but rather by way of an L-shaped pull arm 52 and a Z-shaped pull arm 53. The pull arms can be hinged to the yoke frames 50, as a result of which a certain flexibility with respect to the use of the device in very constricted spaces with little room in the vertical direction is afforded. Thus the relatively thin frames can still be easily pushed over the clip arms, and, because of the lateral guidance given by the pull arms, there is practically no need for any room in the vertical direction. This tensioning part can therefore be used wherever a clamping element with jaws 40, 41, which require vertical insertion room cannot fit. Of course, instead of the closed frame yokes discussed here, it is also possible to use fork-shaped or hook-shaped yokes, designed either for compression (first yoke) or tension (second yoke).

Figure 11:
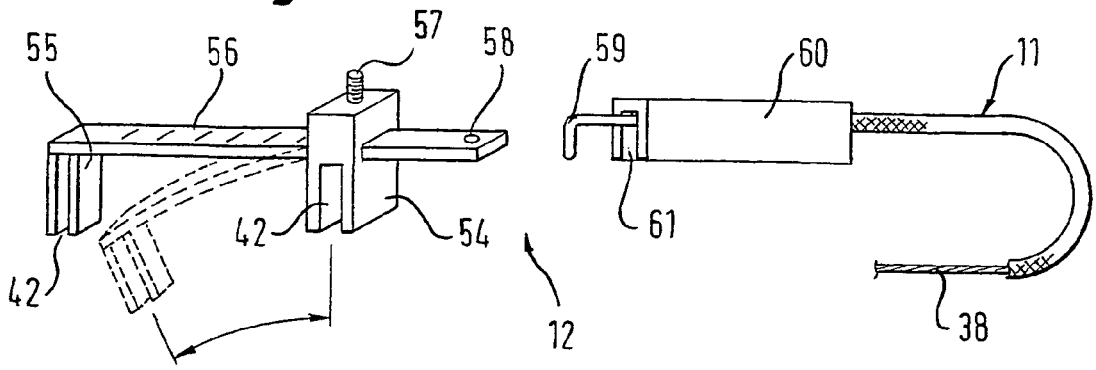
FIG. 11 shows a perspective view of a fourth embodiment of a tensioning part comprising tensioning jaws connected by a movable spring arm.

The exemplary embodiment of the tensioning part shown in FIG. 11 again has jaws 54, 55, which, with respect to their arm-engaging design, are essentially the same as those according to FIGS. 3 and 6–8. Here, however, the two jaws 54, 55 are not connected loosely to each other merely by the Bowden cable core; instead, the outer jaw 55 has a strap-like spring arm 56, the lengthwise dimension of which extends in the tension direction. This spring arm passes with freedom of movement through the first jaw 54 and can be held in position there by means of a setscrew 57. At the end of the spring arm 56 extending out from the jaw 54, a hook eye 58 is provided, into which a hook 59 at the end of the Bowden cable core can be hooked. In addition, a thrust piece 60 is provided, in which the Bowden cable sheath is permanently fastened. This thrust piece has a longitudinal groove 61 in the bottom, which guides the end of the core with its hook 59, which can project out from the end of the groove as shown; the thrust piece is designed to extend over the end of the spring arm. After the hook end of the core has been hooked into the hook eye 58 and obviously after the setscrew 67 has been loosened, the end surface of the thrust piece 60 will come up against the outward-facing end surface of the jaw 54 when the tool is actuated, that is, when the pushrod and thus the Bowden cable sheath are pushed forward. This jaw is thus pushed toward the jaw 55, and simultaneously the spring arm 56 is held firmly in place by the hook 59 of the Bowden cable core. In this exemplary embodiment, it can be seen that, after the spring arms have been squeezed together by the jaws 54, 55 and thus after the hose clamp has been opened, the tensioning part 12 the two jaws 54, 55 can be held in position with respect to each other by tightening the setscrew 57 to clamp the spring arm 56 tightly in the jaw 54. As a result, when the pressure on the tool is released, the Bowden cable and the thrust piece 60 can be disconnected from the tightly clamped jaws 54, 55 by undoing the hook 59. The tool can then be used together with additional jaws 54, 55 to open additional hose clamps, or the tool can simply be set aside, where it will not interfere with subsequent work on the hoses or hose clamps. It can be seen that, because the two jaws 54, 55 are connected to each other by the spring arm 56, which can flex in the jaw insertion direction, the jaws 54, 55 can be seated in optimal fashion on the two arms of a spring clamp, as illustrated by the downward-bent spring arm shown in broken line.

Figure 12:
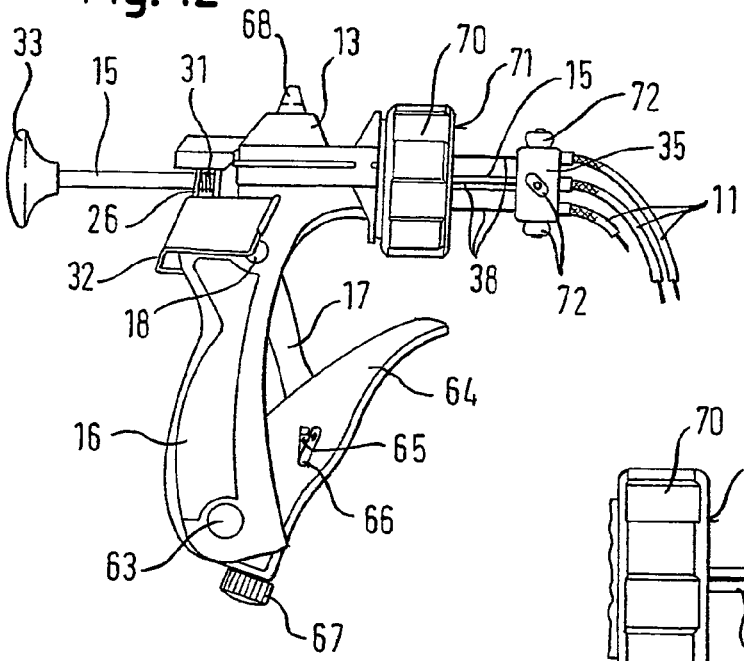
FIG. 12 shows a side view of a second embodiment of a tool with trigger lever actuation and a three-part tensioning device.

In the case of second exemplary embodiment of the tool according to the invention shown in FIG. 12, the associated tensioning element is not included in the drawing. It can be understood, however, that, as required, one of the tensioning element 12 shown in FIG. 3–11 can be used. The actuating part 10 of this embodiment has essentially the same basic elements as that according to FIG. 3. Here, too, a head part 14 and a housing arm 16 are provided, on which, via the pivot axle 18, an actuating arm 17 is attached with freedom to pivot. This arm also acts by way of a thrust arm (not shown in the drawing), a thrust stud, and a thrust washer on the pushrod 15 to push it forward. In this exemplary embodiment, however, pressure is not exerted by hand directly on the arm 17; instead, a trigger type lever is provided at the bottom end of the housing arm 16, which is supported with freedom to pivot on an axle 63. The arm 17 is connected to the trigger lever by a pin 65 in a slot 66. When the trigger lever 46 is pulled, the arm 17 is pushed by the pin 65, as a result of which, with the help of additional elements, the pushrod 16 is pushed forward. By means of a setscrew 67 provided on the trigger lever 64, it is possible to limit the actuation stroke, as also provided in similarly designed cartridge guns. Therefore, there is no need for a detailed discussion of the relevant design elements.

In this embodiment, too, the locking lever 26 and the release arm 32 at the rear of the housing are held under tension by the compression spring 31. Here, however, the release arm 32 is no longer a simple downward-extending piece; it is now U-shaped and extends forward and partially encloses the housing. At the rear of the pushrod 15, a disk is attached instead of the hook-like pull arm. Finally, on the top surface of the head part of the housing, a hook eye 68 is attached or formed on the housing. As can bee seen, the housing is a part made of injection-molded plastic, whereas the housing and the actuating part of the exemplary embodiment according to FIG. 3 can also be fabricated as simple sheet metal parts.

In the case of the embodiment according to FIG. 12, a fastening body 70 is attached to the end surface of the housing; the pushrod 15 also passes through the center of this body with freedom of movement. The front surface 71 of the fastening body 70 now fulfills the role of the end wall 23 of the exemplary embodiment according to FIG. 3. Accordingly, the core 38 of the Bowden cable is attached to it; in this embodiment, three Bowden cables 11 are in fact provided, and thus three cores 38 are attached correspondingly to the fastening body 70. The fastening body 70 can be permanently attached to the housing, and the cores 38 can also be permanently fastened in it. Appropriate measures known in and of themselves, however, can also be taken so that the cores 38 can be easily hooked onto and unhooked from the fastening body 70. Of course, in the case of the triple Bowden cable design, the clamping body 35 is also equipped with three clamping bores for the Bowden cables. It is illustrated here in addition that each of the Bowden cables can be clamped by a setscrew 72, so that the cores can be fixed in position immovably in the sheaths. As a result, in the tensioned state of the tensioning part, the Bowden cables can be unclamped from the clamping body 35, so that the clamping body 35 and the cores 38 can be disconnected or unhooked from the pushrod 15 or from the fastening body 70, and so that the tensioning part can be handled together with the Bowden cables as an independent unit. The actuating part is then free to be used elsewhere.

Figure 13:
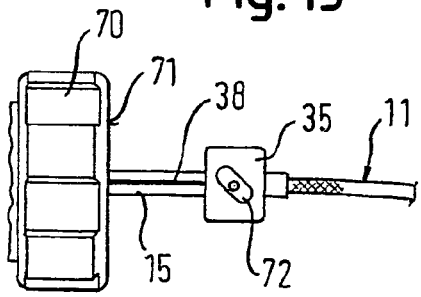
FIG. 13 shows a fastening body with a simple clamping device, fitting the tool according to FIG. 12.

FIG. 13 shows a fastening body 17 after it has been removed from the housing. Only one Bowden cable, which can be fixed in place in the clamping body 35 by the setscrew 72, is attached to the fastening body.

Figure 14:
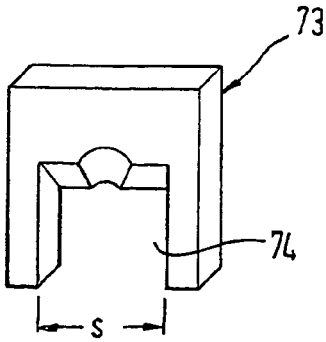
FIG. 14 shows a perspective view of a one-piece retaining yoke.

FIG. 14 shows a retaining yoke 73, which is designed essentially in the form of a U and which serves to retain the clamp arms of the hose clamp after they have been squeezed together, that is, after the hose clamp has been opened. The width of the insertion opening 74 in the retaining yoke 73 is designed so that the yoke reliably grips the arms after the arms have been squeezed together appropriately and the yoke has been pushed axially onto them. After the pressure on the tool has been released, the clamp arms are supported by the yoke arms under pressure. Because, according to the invention, the tensioning stroke can be executed in the form of relatively short, individual strokes until the maximum stroke desired in the specific case has been realized, it is possible, after the tensioning jaws of the tensioning element have been seated on the clamp arms, for the tensioning operation to be performed with one hand until the retaining yoke can be pushed reliably with the other hand over the squeezed-together clamp arms. Then, also with one hand, the actuating part can release the tensioning part by the use of the release arm of the locking lever, so that the spring arms move against the arms of the retaining yoke and are blocked in position there.

Figure 15:
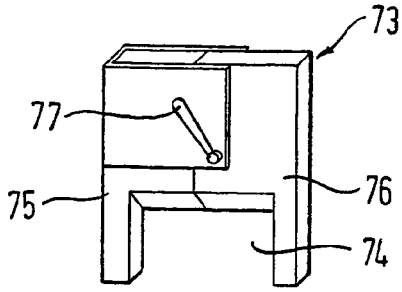
FIG. 15 shows a perspective view of a two-part, adjustable retaining yoke.

In the case of the embodiment of the retaining yoke 73 shown in FIG. 15, finally, a two-part design is shown. Here the retaining yoke consists of two yoke jaws 75, 76, which are able to move with respect to each other and which can be fixed in place with respect to each other by the use of a clamping lever 77. As a result, the width of the retaining opening 74 can be adjusted to the specific need, or the opening can simply be set in place and removed more quickly and more reliably.

Figure 16:
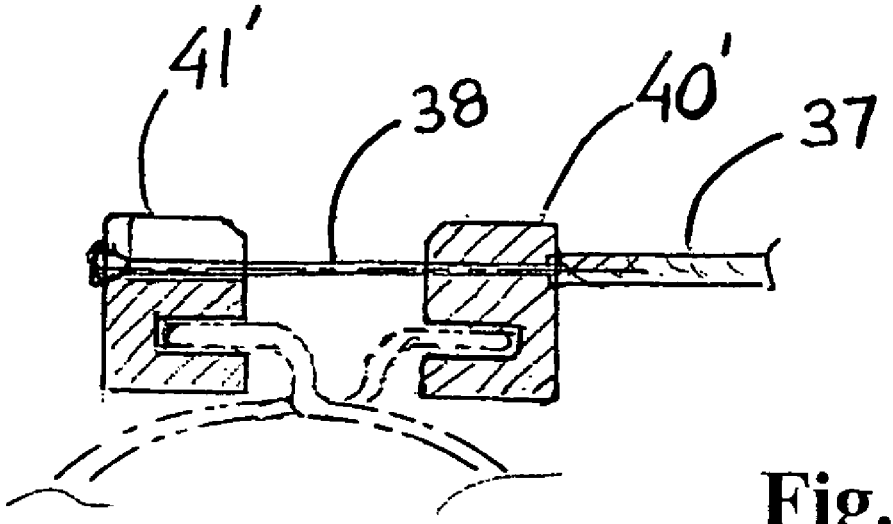
FIG. 16 is a cross-sectional view of another embodiment of the tensioning part with loose blocks.
Figure 17:
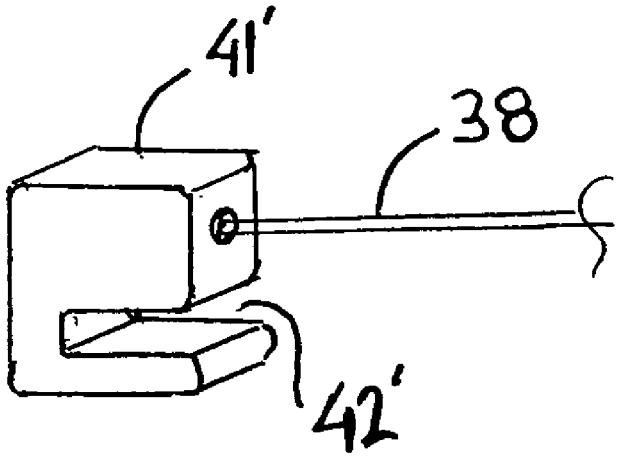
FIG. 17 is a perspective view of one of the jaw blocks of FIG. 16.

FIGS. 16 and 17 show another embodiment of the jaws 40', 41'. Each of the jaws 40', 41' has a transverse slot 42' that extends into the jaw in a direction parallel to the pulling direction of the Bowden cable 38.

| List of Reference Numbers | |
|---|---|
| 1 | hose clamp |
| 2 | clamp arm, narrow |
| 3 | clamp arm, wide |
| 4 | clamp ring |
| 5 | clamping diameter |
| 6 | tab |
| 7 | clamping diameter, expanded |
| 8 | — |
| 9 | end wall, rear |
| 10 | actuating part |
| 11 | Bowden cable |
| 12 | tensioning part |
| 13 | housing |
| 14 | head part |
| 15 | pushrod |
| 16 | housing arm |
| 17 | actuating part arm |
| 18 | pivot axle |
| 19 | thrust arm |
| 20 | thrust pin |
| 21 | thrust washer |
| 22 | compression spring |
| 23 | end wall, forward |
| 24 | bore |
| 25 | notches |
| 26 | locking lever |
| 27 | locking bore |
| 28 | hook arm |
| 29 | hook tab |
| 30 | insertion opening |
| 31 | compression spring |
| 32 | release arm |
| 33 | tension arm |
| 34 | — |
| 35 | clamping body |
| 36 | clamping bore |
| 37 | Bowden cable sheath |
| 38 | Bowden cable core |
| 39 | fastening end |
| 40 | jaw |
| 41 | jaw |
| 42 | transverse slot |
| 43 | hooking block |
| 44 | hooking slot |
| 45 | hooking bore |
| 46 | guide pin |
| 47 | bore |
| 48 | opening |
| 49 | tensioning bar |
| 50 | frame yoke |
| 51 | opening |
| 52 | L-shaped pull arm |
| 53 | Z-shaped pull arm |
| 54 | jaw |
| 55 | jaw |
| 56 | spring arm |
| 57 | setscrew |
| 58 | hooking opening |
| 59 | attachment hook |
| 60 | pressure piece |
| 61 | longitudinal groove |
| 62 | — |
| 63 | axle |
| 64 | trigger lever |
| 65 | pin |
| 66 | slot |
| 67 | adjusting screw |
| 68 | hook eye |

-continued

| List of Reference Numbers | |
|---|---|
| 69 | — |
| 70 | fastening body |
| 71 | end surface |
| 72 | setscrew |
| 73 | retaining yoke |
| 74 | opening |
| 75 | yoke jaw |
| 76 | yoke jaw |
| 77 | clamping lever |

The invention claimed is:

1. A tool for tensioning, loosening, and opening spring-type clamping elements with two radially outward-projecting actuating arms, comprising:

a hand-operable actuating part;

a Bowden cable having a core and a sheath, the Bowden cable being connected to the actuating part; and a tensioning part with two jaws which are movable relative to each other, each of the jaws being configured to engage one of the actuating arms, a first one of the jaws being connected to the core, and a second one of the jaws being connected to the sheath of the Bowden cable so that the jaws are movable toward each other and thus execute a tensioning movement, the actuating part including means for locking in a tensioning stroke and means for feeding the Bowden cable, the feeding means and the locking means of the actuating part being configured to cooperate so that several short tensioning strokes of any desired length are performable without predefined latching steps, the stroke being locked in place each time until a required total tensioning stroke has been completed, the jaws of the tensioning part being loose, independent blocks that are not in contact with one another, or connected to one another either directly or indirectly except for the Bowden cable each of the blocks having a transverse slot so that the respective block forms essentially a U, each slot being configured to enclose one of the two clamp actuating arms.

2. A tool according to claim 1, wherein the feeding means includes a thrust washer and return spring, the locking means including a locking lever, the actuating part having a body and a smooth pushrod which is advanceable in short strokes by the thrust washer and held in place by the locking lever, and which projects out from opposite sides of the actuating part body, the sheath of the Bowden cable being attached to a forward, outer end of the pushrod, and the core of the Bowden cable being attached to an end wall of the actuating part body near an exit point of the pushrod, the body having a head part configured to only accept the thrust washer, the return spring and a longitudinal guide of the pushrod.

3. A tool according to claim 2, and further comprising a clamping body attached to the forward end of the pushrod, the clamping body having a clamping bore for the Bowden cable radially offset and extending parallel to a bore in the clamping body accommodating the pushrod, the clamping body being attached in a detachable manner to the pushrod, the core of the Bowden cable being attached in a detachable manner to the end wall of the actuating part body, and further comprising means for holding the Bowden cable in place in the clamping body so that the core of the Bowden cable is held in place immovably in the Bowden cable sheath.

4. A tool according to claim 3, wherein the holding means includes radial set screws.

5. A tool according to claim 3, wherein the clamping body has a plurality of receiving bores to hold several Bowden cables, the receiving bores being arranged symmetrically to the pushrod bore.

6. A tool according to claim 2, and further comprising a fastening body detachably mounted on the end wall of the actuating part body through which fastening body the pushrod passes and to which the end of the core is attached.

7. A tool according to claim 1, wherein the core of the Bowden cable passes through the second jaw block so as to be easily movable whereas the sheath is clamped in place in the second jaw block, the core projecting from the sheath being attached to the first jaw block.

8. A tool according to claim 7, wherein the second jaw has a hooking slot transverse to an insertion slot provided on a top surface of the jaw so that the core is hooked onto the first jaw.

9. A tool according to claim 1, wherein the transverse slots are formed in the jaws perpendicular to a pulling direction of the Bowden cable.

10. A tool according to claim 1, wherein the transverse slots are formed in the jaws parallel to a pulling direction of the Bowden cable.

* * * * *